US006662860B2

(12) United States Patent
Iwamoto et al.

(10) Patent No.: US 6,662,860 B2
(45) Date of Patent: Dec. 16, 2003

(54) HEAT TRANSFER PIPE FOR LIQUID MEDIUM HAVING GROOVED INNER SURFACE AND HEAT EXCHANGER EMPLOYING THE SAME

(75) Inventors: Takashi Iwamoto, Muroran (JP); Shinichi Ono, Muroran (JP); Yukio Sato, Muroran (JP); Masayuki Kawai, Muroran (JP); Yasushi Owaki, Muroran (JP); Masashi Tomiie, Tokyo (JP); Shunroku Sukumoda, Aizuwakamatsu (JP); Kohtaroh Nagahara, Aizuwakamatsu (JP)

(73) Assignee: The Japan Steel Works, Ltd., Tokyo (JP)

( * ) Notice: Subject to any disclaimer, the term of this patent is extended or adjusted under 35 U.S.C. 154(b) by 0 days.

(21) Appl. No.: 10/200,449

(22) Filed: Jul. 23, 2002

(65) Prior Publication Data

US 2003/0019614 A1 Jan. 30, 2003

(30) Foreign Application Priority Data

Jul. 24, 2001 (JP) ..... 2001-223636

(51) Int. Cl.[7] ..... F28F 13/18
(52) U.S. Cl. ..... 165/133; 165/184; 138/38
(58) Field of Search ..... 165/133, 184; 138/38, 171, 121

(56) References Cited

U.S. PATENT DOCUMENTS

| | | | | | |
|---|---|---|---|---|---|
| 4,402,359 | A | * | 9/1983 | Carnavos et al. | 165/70 |
| 4,658,892 | A | * | 4/1987 | Shinohara et al. | 165/133 |
| 5,259,448 | A | * | 11/1993 | Masukawa et al. | 165/133 |
| 5,692,560 | A | * | 12/1997 | Messant et al. | 165/184 |
| 5,803,164 | A | * | 9/1998 | Schuez et al. | 165/184 |
| 5,862,857 | A | * | 1/1999 | Ishikawa et al. | 165/184 |
| 6,056,048 | A | * | 5/2000 | Takahashi et al. | 165/184 |
| 6,164,370 | A | * | 12/2000 | Robinson et al. | 165/133 |
| 6,173,763 | B1 | * | 1/2001 | Sano et al. | 165/133 |
| 6,182,743 | B1 | * | 2/2001 | Bennett et al. | 165/133 |
| 6,308,775 | B1 | * | 10/2001 | Naumann | 165/133 |

FOREIGN PATENT DOCUMENTS

JP 59-084093 5/1984

* cited by examiner

*Primary Examiner*—Terrell McKinnon
(74) *Attorney, Agent, or Firm*—Sughrue Mion, PLLC

(57) ABSTRACT

In a heat transfer pipe, annular grooves in a direction inclined at an angle of 45° to 90° with respect to an axis of the pipe are continuously formed at an interval in a longitudinal direction of the pipe. The annular grooves desirably have a groove depth of 0.20 mm or more, and a groove pitch of two to five times larger than the groove depth. Moreover, a ratio W/P of a bottom width W of projections of the grooves to the groove pitch P is desirably 0.1 to 0.9.

8 Claims, 5 Drawing Sheets

HEAT TRANSFER PIPE FOR LIQUID MEDIUM HAVING GROOVED INNER SURFACE AND HEAT EXCHANGER EMPLOYING THE SAME

The present application is based on Japanese Patent Application No. 2001-223636, which is incorporated herein by reference.

BACKGROUND OF THE INVENTION

1. Field of the Invention

The present invention relates to a heat transfer pipe for a liquid medium having a grooved inner surface into which the liquid medium is introduced to conduct heat exchange between the liquid medium, and gas, liquid and solid substance outside the pipe, and also relates to a heat exchanger employing the heat transfer pipe.

2. Related Art

Such a heat transfer pipe for a liquid medium having a grooved inner surface into which the liquid medium flows to conduct heat exchange between the liquid medium, and gas, liquid and solid substance outside the pipe has been conventionally incorporated in a heat exchanger as a part of the heat exchanger. Material selection and shape design of the heat transfer pipe have been made so that favorable heat exchanging efficiency can be obtained. As one of the examples, there has been a proposal for enhancing the heat transferring efficiency between the pipe and the liquid medium by forming lead grooves or ribs on an inner surface of the heat transfer pipe so as to give agitating action to the liquid medium.

For example, in case of a grooved pipe which has been usually used, there are formed grooves having a lead angle of ten degree or more.

In Japanese Publication No. JP-A-59-84093 of an unexamined patent application, there is proposed a heat transfer pipe in which ribs formed on an inner surface of the pipe are in a trapezoidal shape having a standing plane on a face opposed to a flow of the liquid medium which stands at a right angle with respect to an axis of the pipe, and an inclined plane on a face in a direction of the flow, so that a turbulent flow may be created and agitating performance of the liquid medium may be enhanced thereby improving heat transfer.

However, in the aforesaid grooved pipe, effect of improving the heat exchanging efficiency has been insufficient, because when the liquid medium flows on an inner surface of the pipe provided with grooves having a groove pitch of 1.5 mm and a lead angle of 15 degree, remarkable improvement in heat transferring efficiency can not be obtained, as shown in FIG. 10, as compared with a smooth inner surfaced pipe. Moreover, in many cases, the heat transfer pipe is inserted into plate fins and widened for use. When the pipe is widened with a mandrel having a spherical projection, there is a problem that projected portions of the pipe are liable to be crushed, because the projected portions pressed with the mandrel are decreased in number, as the lead angle of the grooves becomes larger.

Further, in the heat transfer pipe provided with the trapezoidal ribs on the inner surface of the pipe, it has been difficult to form the standing plane of the right angle with high molding accuracy, due to a complicated sectional shape of the rib. This will lead to an increase of production cost. Specifically, it has been difficult to keep the angle of the standing plane at 90° while sufficiently maintaining a height required for creation of the turbulent flow. It has been also difficult to fully mold up to a tip end portion of the rib, and there has been a probability that a corner part may be molded in a smooth curve. Hence, there has been a problem that it would be difficult to obtain required performance with reliability.

SUMMARY OF THE INVENTION

The present invention has been made on a background of the above described circumstances, and an object of the present invention is to provide a heat transfer pipe for a liquid medium provided with grooves in which heat exchanging performance can be remarkably enhanced, with relatively small pressure loss and least collapse of the grooves when the pipe is widened, and also a heat exchanger employing this heat transfer pipe.

(1) In order to solve the above described problems, according to the invention, there is provided a heat transfer pipe for a liquid medium having a grooved inner surface, there is provided the heat transfer pipe for a liquid medium having a grooved inner surface in which heat exchange is conducted with movement of the liquid medium in the pipe, characterized in that there are formed, on an inner surface of the heat transfer pipe, annular or spiral grooves in a direction inclined at an angle of 45° to 90° with respect to an axis of the pipe, and that the annular or spiral grooves are continuously formed at a predetermined interval in a longitudinal direction of the pipe.

(2) The invention of the heat transfer pipe for a liquid medium having a grooved inner surface according to the above (1) is characterized in that the annular or spiral grooves have a groove depth of 0.20 mm or more, and a groove pitch of two to five times larger than the groove depth.

(3) The invention of the heat transfer pipe for a liquid medium having a grooved inner surface according to (1) or (2) is characterized in that a ratio W/P of a bottom width W of a projection formed between the annular or spiral grooves to the groove pitch P is 0.1 to 0.9.

(4) The invention of the heat transfer pipe for a liquid medium having a grooved inner surface according to any one of (1) to (3) is characterized in that the heat transfer pipe is a welded pipe having a welded portion.

(5) The invention of the heat exchanger is characterized by including the heat transfer pipe for a liquid medium having a grooved inner surface according to any one of (1) to (4).

(6) The invention of the heat exchanger according to (S) is characterized in that the heat transfer pipe for a liquid medium having a grooved inner surface is inserted into a plurality of plate fins which are arranged in parallel, and widened so as to be tightly fitted to the plate fins.

(7) The heat transfer pipe according to (1) is characterized in that the projection has an inclined surface with respect to the flow of the liquid medium on a side where the liquid medium flows in.

(8) The heat transfer pipe according to (7) is characterized in the said projection has a shape of crest.

Specifically, according to the heat transfer pipe for a liquid medium having a grooved inner surface as described (1), the liquid medium flowing inside the pipe will be appropriately agitated by means of the annular or spiral grooves having an adequate angle difference with respect to the pipe axis, and heat transfer to the pipe can be effectively improved. Pressure loss on this occasion is small and efficiency in general will be remarkably increased. In addition, when the pipe is widened, there is little collapse of the projection between the grooves, and deterioration of the efficiency will be avoided. In case where the angle difference with respect to the pipe axis is less than 40°, sufficient improvement of the heat transfer cannot be obtained, since flows along the grooves are liable to occur, and agitating action of the liquid medium becomes insufficient. Moreover, even though the above mentioned angle difference is larger than 90° in a particular rotation direction, an angle difference in a reverse rotation direction can be regarded as less than 90°. Therefore, the direction of the grooves with respect to the pipe axis is limited to be 45° to 90°.

Moreover, it is desirable that the annular or spiral grooves may have a groove depth of 0.20 mm or more, and a groove pitch of two to five times larger than the groove depth, as described in (2). Generally, the heat transfer pipe of the heat exchanger has a diameter of 7 mm to 20 mm, and so, the depth of the groove may desirably be 0.20 mm or more. With the depth less than 0.20 mm, sufficient agitating action of the liquid medium cannot he obtained. Further, the depth of the groove is desirably less than 1 mm. This is because with too large depth of the groove, the turbulent flow becomes violent, causing a larger pressure loss. By making the groove pitch two to five times larger than the groove depth, the agitating action of the liquid medium will be more effective. In case where the groove has the groove pitch less than twice as large as the groove depth, the liquid medium will make nearly a laminar flow, and the agitating effect of the liquid medium will be rather decreased. In contrast, when the groove pitch is more than five times as large as the groove depth, effect of creating the turbulent flow will be decreased, and sufficient agitating action of the liquid medium cannot be obtained. Therefore, the groove pitch is desirably two to five times larger than the groove depth.

Still further, it is desirable that the annular or spiral grooves may have the ratio W/P of the bottom width W of the projection formed between the annular or spiral grooves to the groove pitch P is 0.1 to 0.9, as described in (3). By limiting the ratio W/P within the above described range, collapse of the projection when the pipe is widened can be advantageously reduced. In case where this ratio is less than 0.1, the width of the projection is relatively small, and the projection is liable to collapse. In contrast, in case where the ratio is more than 0.9, the width of the bottom is relatively small, and creation of the turbulent flow will be insufficient, resulting in insufficient agitating action of the liquid medium.

It is to be noted that when the bottom of the projection is curved as shown in FIGS. 6A and 6B, the bottom width W is represented with reference to a position in which substantial wall faces of the projection and a substantial bottom face of the groove intersect in a direction of plane.

The above described heat transfer pipe for a liquid medium having a grooved inner surface according to the present invention can be installed in a heat exchanger to conduct heat exchange with liquid, gas and solid substance inside the heat exchanger (outside the heat transfer pipe), and can be incorporated as a part of the heat exchanger. In some cases, fins are attached to an outer face of the heat transfer pipe in order to increase heat exchanging efficiency. On occasion of attaching, the heat transfer pipe is generally inserted into a plurality of plate fines which are arranged in parallel, and widened with a mandrel or the like to be tightly fitted to the plate fins.

DETAILED DESCRIPTION OF THE PREFERRED EMBODIMENTS

Now, an embodiment of the present invention will be described referring to FIGS. 1 to 3.

Figure 1:
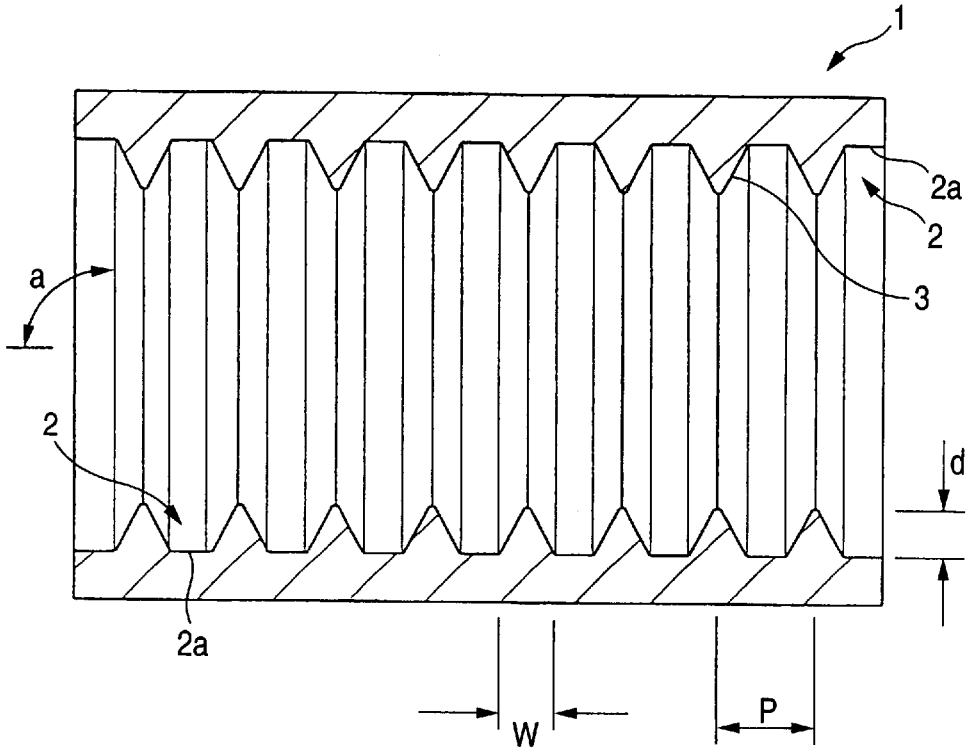
FIG. 1 is a sectional front view of a heat transfer pipe in an embodiment according to the present invention.
Figure 2:
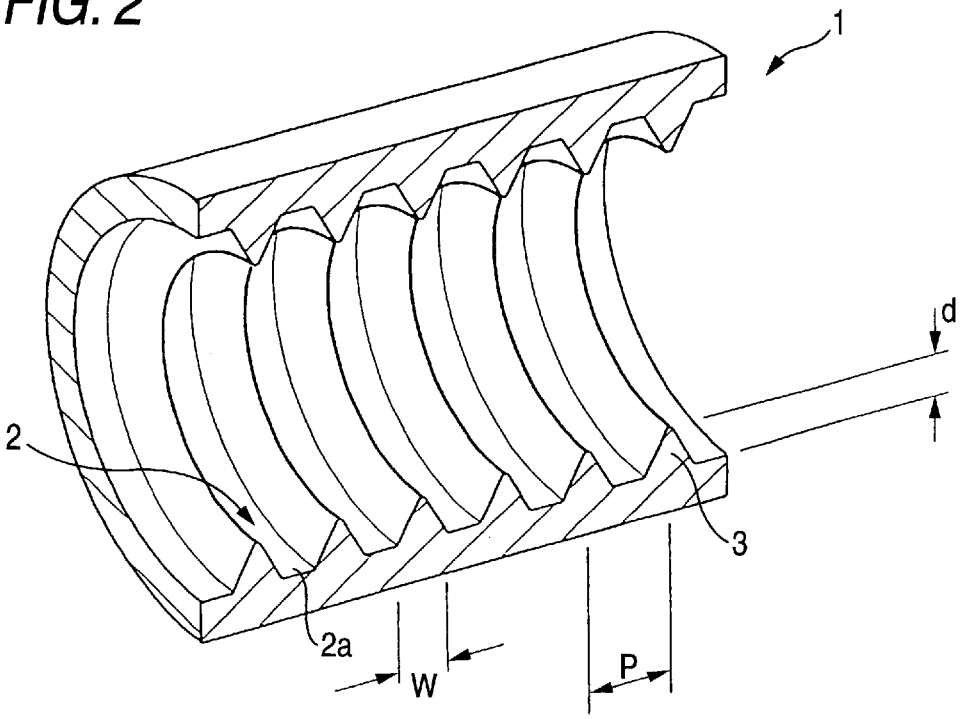
FIG. 2 is a sectional perspective view of the same.

As shown in FIGS. 1 and 2, there are formed, inside a heat transfer pipe 1 in a cylindrical shape, annular grooves 2 in a direction inclined at an angle of 45° to 90° with respect to an axis of the pipe. Each of the annular grooves 2 has a flat bottom 2*a*, and a projection 3 in a shape of crest is formed between a pair of the annular grooves 2. In other words, the projection has an inclined surface with respect to the flow of the liquid medium on a side where the liquid medium flows in.

The above described annular groove 2 has a depth d of 0.2 to 1 mm, and a groove pitch P of two to five times larger than the depth of the groove. Ratio of a width W of a bottom of the projection 3 to the above described groove pitch (W/P) is 0.1 to 0.9.

When a liquid medium is introduced into this heat transfer pipe 1, an appropriate turbulent flow will be created, and with agitating action of the liquid medium, effective heat transfer can be conducted between the liquid medium and the heat transfer pipe.

Figure 3:
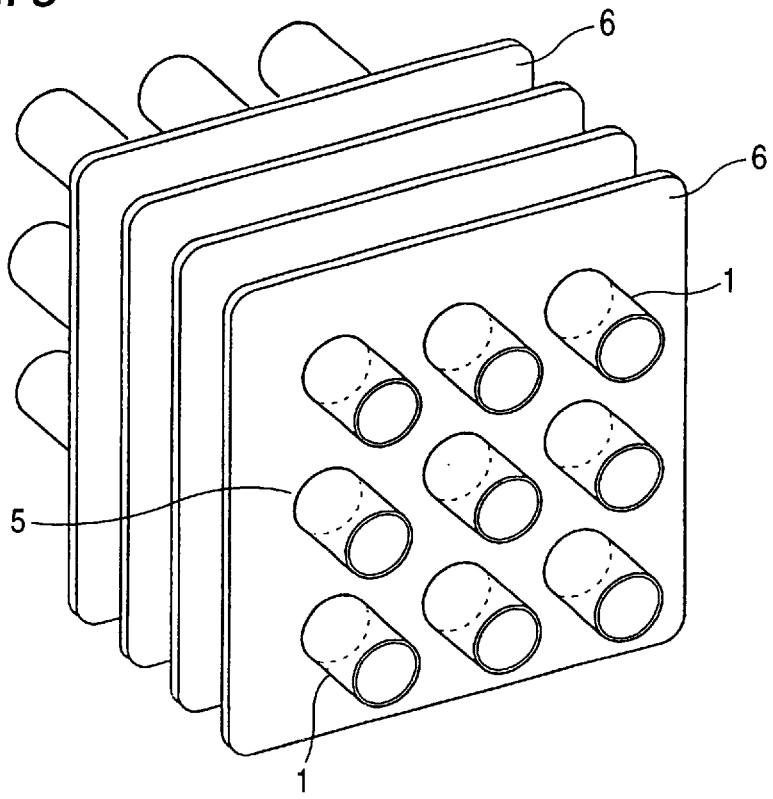
FIG. 3 is a perspective view of a part of a heat exchanger showing the heat transfer pipes according to the present invention in a state fixed to fins.

FIG. 3 is a view showing the above described heat transfer pipes 1 which have been inserted into through holes 5 in plate fins 6 to pass them through, and widened with a mandrel (not shown) so that the heat transfer pipes 1 can be tightly fitted to the plate fins 6. The heat transfer pipes 1 and the plate fins 6 are contained in a main body of a heat exchanger (not shown) as a part of the heat exchanger. On occasion that the heat transfer pipes 1 are tightly fixed to the plate fins 6, there will be least collapse of the projections 3, and the heat transferring ability of the heat transfer pipe will not be lost. The heat exchanger has a favorable heat exchanging efficiency because of the favorable heat transferring ability.

Figure 4:
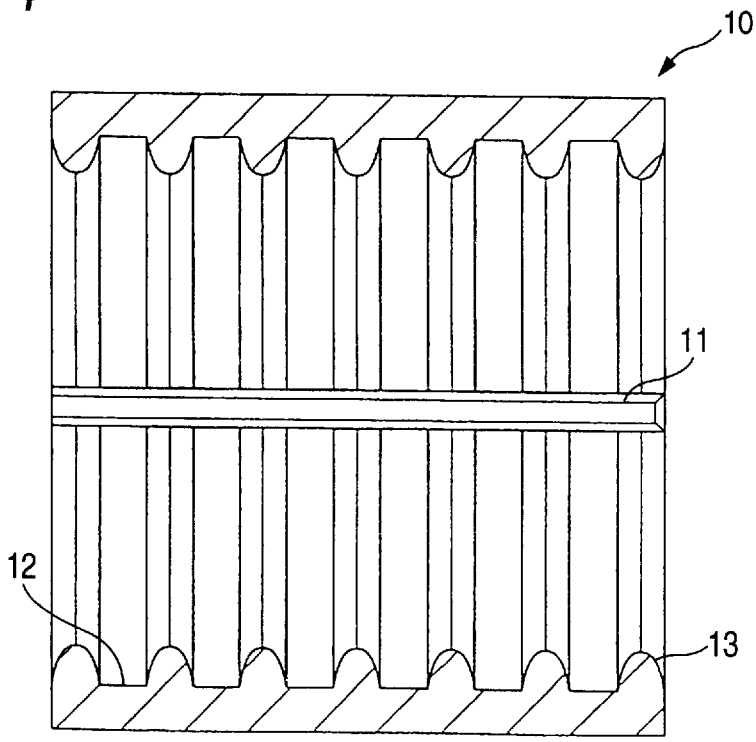
FIG. 4 is a sectional front view of a heat transfer pipe in a further embodiment.

FIG. 4 shows a heat transfer pipe 10 in a further embodiment of the invention. This heat transfer pipe 10 has annular grooves 12 and projections 13 in the same manner as in the above described embodiment. An only difference lies in that the heat transfer pipe 10 is a welded pipe having a welded portion 11. In other words, a method of producing the heat transfer pipe according to the present invention is not particularly limited, and whether the heat transfer pipe is a seamless pipe or a welded pipe, for example, is not a matter of concern.

Figure 5:
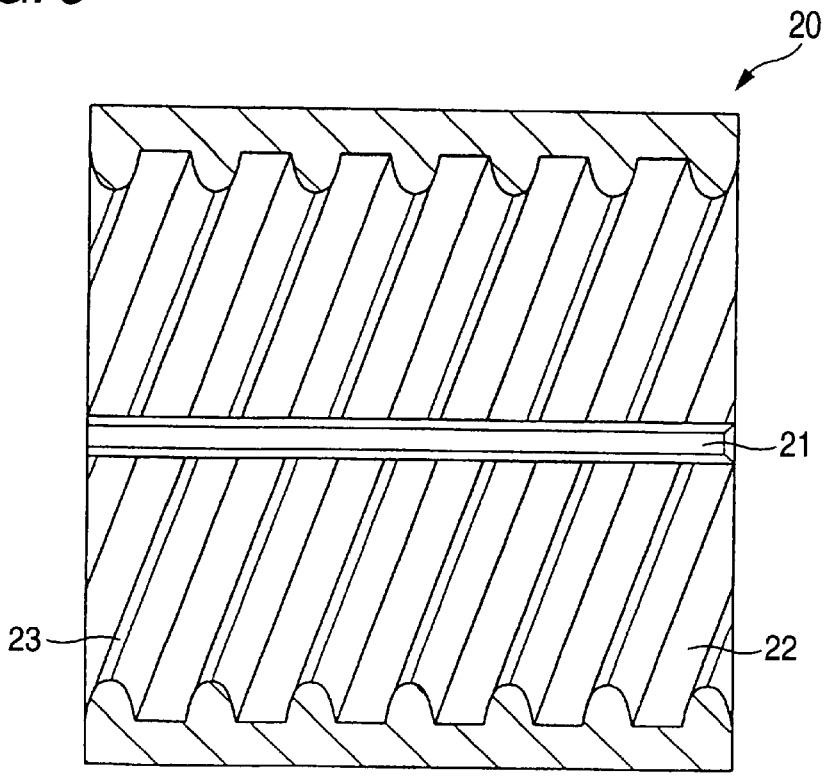
FIG. 5 is a sectional front view of a heat transfer pipe in a still further embodiment.
Figure 6A:
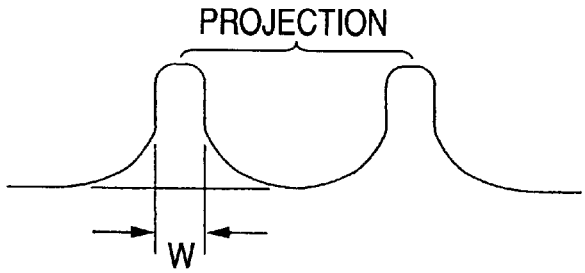
FIGS. 6A and 6B are views for explaining a bottom width of a projection formed between the grooves according to the present invention.
Figure 6B:
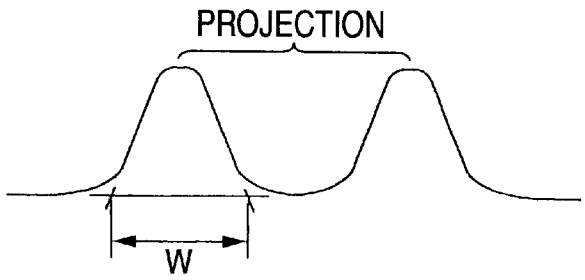

FIG. 5 shows a heat transfer pipe 20 in a still further embodiment. This heat transfer pipe 20 is also a welded pipe having a welded portion 21 in the same manner as in the above described embodiment. The heat transfer pipe 20 in this embodiment is provided with spiral grooves 22 having an angle difference of 60° with respect to an axis of the pipe. This spiral grooves 22 are continued in a direction of the pipe axis and have projections 23 between the grooves. In short, the grooves in the present invention may be either of the annular grooves or the spiral grooves.

EXAMPLES

Examples of the present invention will be described in comparison with comparative examples, as follow;

Example 1

Figure 7:
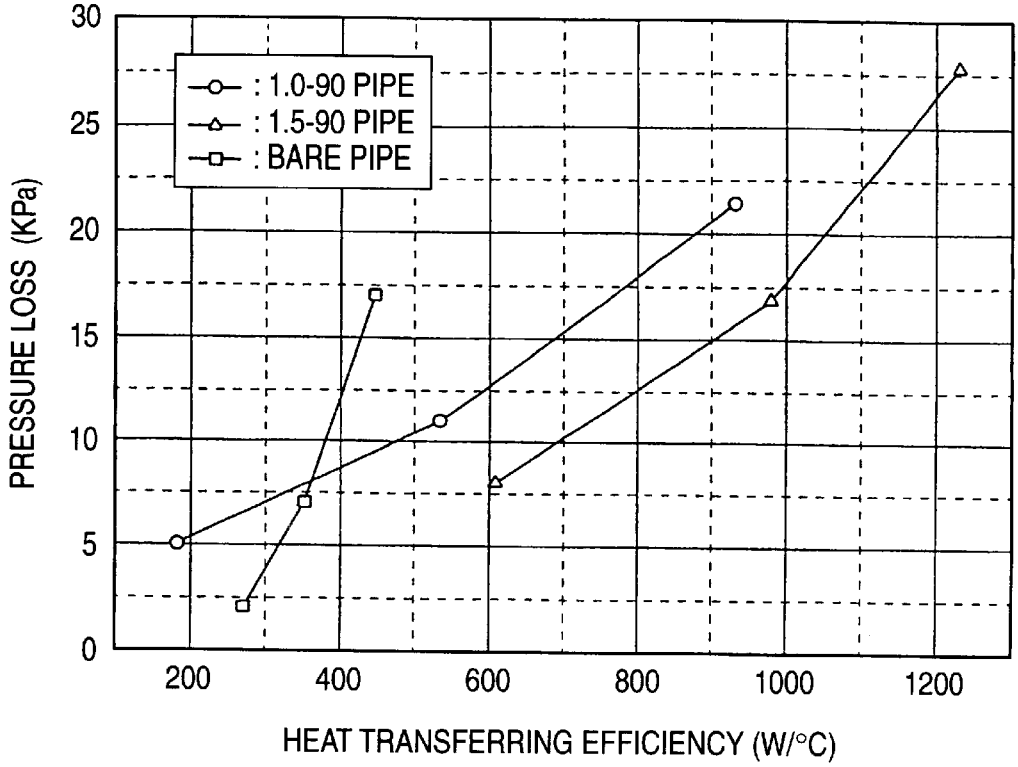
FIG. 7 is a graph showing relation between heat transferring performance and pressure loss in an example of the present invention.

As a first step, heat transfer pipes according to the present invention each having an inner diameter of 10.4 mm, and an inner surface provided with annular grooves which have a groove depth of 0.4 mm and a groove pitch of 1 mm or 1.5 mm, and are inclined at an angle of 90° with respect to a pipe axis have been prepared. For the purpose of comparison, a bare heat transfer pipe having the same inner diameter but provided with no annular groove has been prepared. In these heat transfer pipes, relations between amounts of heat exchanged and pressure losses have been examined, and the results are shown in FIG. 7. Here, a 30% aqueous methanol solution was introduced into the pipe as liquid medium inside the pipe (Measured temperature: −10° C., and Measured flow rates; 1, 1.5, 2 m/s). The liquid medium outside the pipe was water (Measured temperature: 20° C., and Measured flow rate: 1.35 m/s). The liquid mediums inside and outside the pipe flow opposite to each other.

As apparent from the graph, it is found that high heat transferring performance in contrast with the pressure losses can be obtained with the heat transfer pipes according to the present invention, as compared with the bare heat transfer pipe.

Example 2

At the next step, a hydrogen storage alloy was filled between fins fixed to the heat transfer pipes, and aqueous methanol solution was introduced into the pipes so as to examine heat exchanging performance by heat absorbing reaction caused from a discharge of hydrogen from the hydrogen occluded alloy. In this embodiment, a heat transfer pipe having an inner diameter of 10.4 mm, and provided with annular grooves which have a groove depth of 0.4 min, a groove pitch of 1.5 mm, and an inclined angle of 900 with respect to a pipe axis was employed. A bare pipe having the same inner diameter was prepared for comparison, also in this example. The results of measurements are shown in FIGS. 8 and 9.

Figure 8:
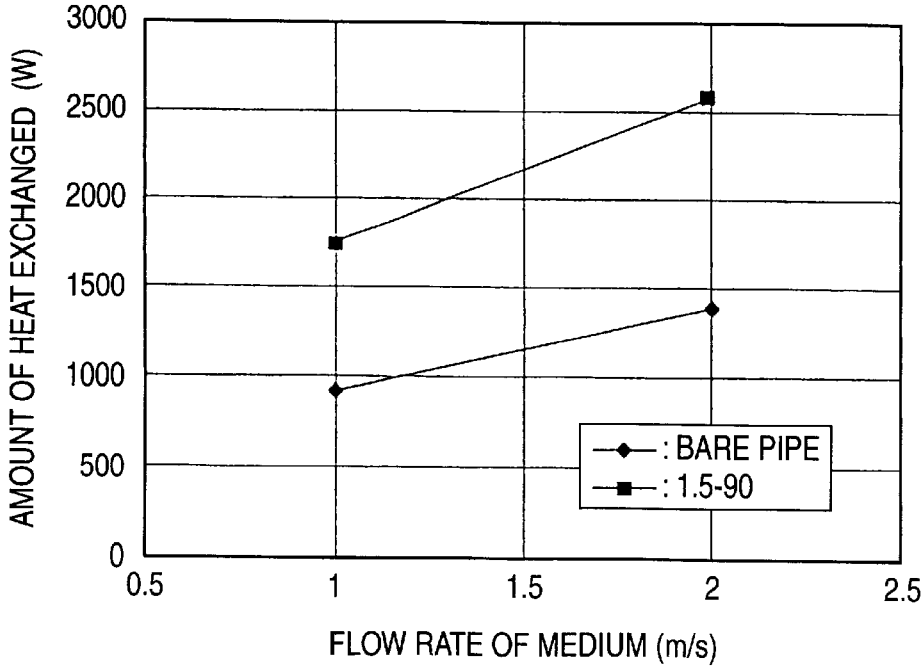
FIG. 8 is a graph showing relation between flow rate of a medium and amounts of heat exchanged in another example.
Figure 9:
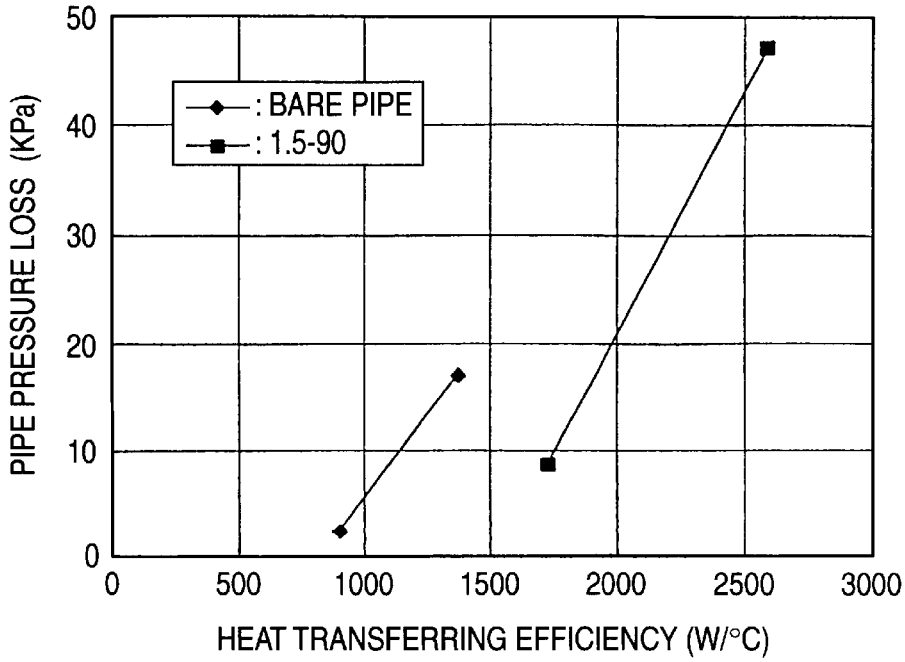
FIG. 9 is a graph showing relation between heat transferring efficiency and pressure loss in the pipe.
Figure 10:
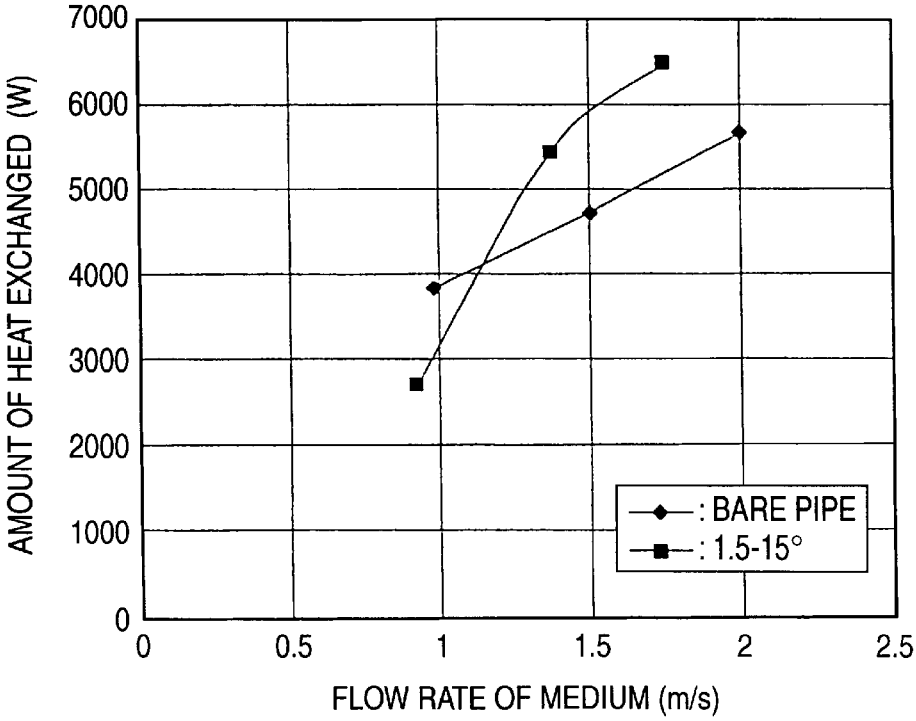
FIG. 10 is a graph showing relation between flow rate of a medium and amounts of heat exchanged in conventional heat transfer pipes with and without grooves.

As apparent from FIG. 8, the heat transfer pipe according to the present invention has shown heat transferring efficiency of 1.5 times more than the bare pipe. Further in FIG. 9, relation between pressure loss in an entire apparatus and the heat transferring efficiency is shown. By employing the heat transfer pipe according to the present invention, the pressure loss can be reduced to less than one half, and pump power will be reduced to almost one half.

Example 3

Then, a manner in which a height of the projections changes, when the heat transfer pipe according to the present invention was widened, has been examined, and the results are shown in Table 1. In this heat transfer pipe, annular grooves have a groove depth of 0.4 mm and a groove pitch (P) of 1.65 mm, an inclined angle of 90° with respect to a pipe axis, a bottom width (w) of 0.80 mm, and W/P of 0.49. As apparent from the table, with progress of the pipe widening process, small and sufficient height of the projection, that is, sufficient depth of the groove is maintained.

TABLE 1

| | Before pipe is widened | After pipe is Widened (1) 11.16 | (2) 11.26 | (3) 11.36 |
|---|---|---|---|---|
| Outer diameter | 12.69 | 13.31 | 13.38 | 13.50 |
| Height of projection | 0.451 | 0.388 | 0.396 | 0.389 |
| Thickness of bottom | 0.743 | 0.704 | 0.698 | 0.681 |
| Widening rate | — | 1.049 | 1.054 | 1.063 |

Unit: mm

As described herein above, according to the heat transfer pipe for a liquid medium provided with the grooves on its inner surface of the present invention, the annular or spiral grooves are formed in a direction inclined at an angle of 45° to 90° with respect to an axis of the pipe, and the annular or spiral grooves are continuously formed in a longitudinal direction of the pipe at an interval. As the results, appropriate turbulent flows are created in a flow of the liquid medium without forming the standing plane standing at the right angle with respect to the axis of the pipe, and heat transferring ability can be improved. Pressure loss on such occasions can be minimized, and when this heat transfer pipe is incorporated in a heat exchanger, heat exchanging efficiency of the heat exchanger will be enhanced. By rendering the aforesaid annular or spiral grooves to have a groove depth of 0.20 mm or more, and a groove pitch of two to five times larger than the groove depth, the above described effects will be made more remarkable.

In addition, by determining the ratio W/P of the bottom width W of the projection formed between the annular or spiral grooves to the groove pitch P to be 0.1 to 0.9, the projection will be restrained from collapsing, when the heat transfer pipe is fixed to the fins by widening the pipe. In this manner, the above described advantages owing to the presence of the annular or spiral grooves will not be lost by the widening process.

What is claimed is:

1. A heat transfer pipe for conducting heat exchange with movement of a liquid medium therein, comprising:

annular or spiral grooves formed on an inner surface of said heat transfer pipe, said grooves being continuously formed at a predetermined interval in a longitudinal direction of said heat transfer pipe:

wherein an extending direction of said grooves is inclined at an angle of more than 50°, but no more than 90° with respect to an axis of said heat transfer pipe, wherein a ratio W/P of a bottom width W of a projection formed between said grooves to said groove pitch P is 0.1 to 0.9.

2. A heat transfer pipe for conducting heat exchange with movement of a liquid medium therein, comprising:

annular grooves formed on an inner surface of said heat transfer pipe, said grooves being continuously formed at a predetermined interval in a longitudinal direction of said heat transfer pipe;

wherein an extending direction of said grooves is inclined at an angle of 90° with respect to an axis of said heat transfer pipe.

3. The heat transfer pipe according to claim 2, wherein said grooves have a groove depth of 0.20 mm or more, and a groove pitch of 2 to 5 times larger than said groove depth.

4. The heat transfer pipe according to claim 2, wherein said heat transfer pipe is a welded pipe having a welded portion.

5. A heat exchanger including the heat transfer pipe according to claim 2.

6. The heat exchanger according to claim 5, further comprising a plurality of plate fins arranged in parallel into which said heat transfer pipe is inserted, wherein said pipe is widened so as to be tightly fitted to said plate fins.

7. The heat transfer pipe according to claim 2, wherein said projection has an inclined surface with respect to the flow of the liquid medium on a side where the liquid medium flows in.

8. The heat transfer pipe according to claim 7, wherein said projection has a shape of crest.

* * * * *